US009041501B2

(12) United States Patent
Carlen et al.

(10) Patent No.: US 9,041,501 B2
(45) Date of Patent: May 26, 2015

(54) AMORPHOUS TRANSFORMER CORE

(75) Inventors: Martin Carlen, Niederrohrdorf (CH); Marcos Bockholt, Paderborn (DE); Benjamin Weber, Winterberg (DE)

(73) Assignee: ABB TECHNOLOGY AG, Zurich (CH)

( * ) Notice: Subject to any disclaimer, the term of this patent is extended or adjusted under 35 U.S.C. 154(b) by 375 days.

(21) Appl. No.: 13/311,104

(22) Filed: Dec. 5, 2011

(65) Prior Publication Data

US 2012/0139682 A1 Jun. 7, 2012

(30) Foreign Application Priority Data

Dec. 7, 2010 (EP) ..... 10193977

(51) Int. Cl.

| | |
|---|---|
| ***H01F 27/08*** | (2006.01) |
| ***H01F 27/24*** | (2006.01) |
| ***H01F 27/22*** | (2006.01) |
| ***H01F 27/25*** | (2006.01) |
| ***H01F 41/02*** | (2006.01) |

(52) U.S. Cl.

CPC ..... *H01F 27/22* (2013.01); *H01F 27/25* (2013.01); *H01F 41/0226* (2013.01)

(58) Field of Classification Search

USPC ..... 336/55, 60, 61, 62, 213

See application file for complete search history.

(56) References Cited

U.S. PATENT DOCUMENTS

| | | | | |
|---|---|---|---|---|
| 3,183,461 | A * | 5/1965 | Tipton | 336/60 |
| 3,810,303 | A * | 5/1974 | Hoell | 29/605 |
| 5,954,988 | A * | 9/1999 | Lee | 219/757 |
| 2002/0067239 | A1 * | 6/2002 | Nathasingh et al. | 336/234 |
| 2004/0257187 | A1 * | 12/2004 | Drummond et al. | 336/61 |
| 2005/0253678 | A1 * | 11/2005 | Nishino et al. | 336/229 |
| 2008/0211612 | A1 * | 9/2008 | Compter | 336/61 |

FOREIGN PATENT DOCUMENTS

| | | | |
|---|---|---|---|
| EP | 2251875 | A1 * | 11/2010 |
| JP | 57093510 | A * | 6/1982 |
| JP | 61084007 | A * | 4/1986 |
| JP | 03124007 | A * | 5/1991 |

* cited by examiner

*Primary Examiner* — Tsz Chan

(74) *Attorney, Agent, or Firm* — Buchanan Ingersoll & Rooney PC

(57) ABSTRACT

The disclosure relates to an amorphous transformer core including at least one transformer core disc with a plurality of layers of strip-like amorphous core material arranged concentrically around at least one winding window. At least one heat dissipating plate extends into an interior of the amorphous transformer core and is fed from there into at least one heat exchange region outside the amorphous transformer core. This can enhance dissipation of heat energy which is produced inside the amorphous transformer core.

13 Claims, 2 Drawing Sheets

AMORPHOUS TRANSFORMER CORE

RELATED APPLICATION(S)

This application claims priority under 35 U.S.C. §119 to European Patent Application No. 10193977.5 filed in Europe on Dec. 7, 2010, the entire content of which is hereby incorporated by reference in its entirety.

FIELD

The disclosure relates to an amorphous transformer core including, for example, at least one transformer core disc with a plurality of layers of strip-like amorphous core material arranged concentrically around at least one winding window.

BACKGROUND INFORMATION

It is known that transformers for energy transmission, for example, at a voltage level of 10 kV to 110 kV and above, can produce core losses in continuous operation. These losses can be ascribed to the re-magnetizing losses and hysteresis losses of a known laminated iron core and can cause a heating thereof. In order to reduce these undesirable losses, transformers which can reduce core losses have recently been built with cores made of an amorphous material.

However, the use of amorphous materials involves new designs and working methods as larger core cross sections may be used due to the lower flux density compared with a known transformer core. An amorphous core material can be more sensitive to higher temperatures than a grain-oriented core plate.

Transformer cores of this kind can be manufactured from a thin amorphous strip material which is arranged in a plurality of layers, for example several thousand, concentrically around one or more winding windows. One lamination usually covers one layer, for example, a circular angle of about 360°. A small overlap can be implemented, if desired. A supporting structure can be useful here, by which the core structure can be stabilized. In addition, the amorphous material, which can be available as a flat strip material, can be mechanically sensitive. The available widths of the strip material can be limited, for example to 200 mm. This can also restrict the sizes of a transformer core which can be realized mechanically. Therefore, in order to realize larger amorphous transformer cores, a plurality of congruent transformer core discs, the width of which can be limited by the width of the available strip material, can be arranged adjacent to one another and joined to one another.

However, cooling of the core can be more important with amorphous cores than with cores made of grain-oriented core plate, as the saturation induction, and therefore the nominal induction, can be dependent on the operating temperature. The possible nominal induction can decrease with increasing temperature. This can then be compensated for by an increased use of material.

SUMMARY

An amorphous transformer core is disclosed comprising: at least one transformer core disc with a plurality of layers of strip-like amorphous core material arranged concentrically around at least one winding window; and at least one heat dissipating plate extending into an interior of the amorphous transformer core that is fed from the interior to at least one heat exchange region outside the amorphous transformer core for dissipation of heat energy produced inside the amorphous transformer core.

A transformer is disclosed comprising: an amorphous transformer core having at least one transformer core disc with a plurality of layers of strip-like amorphous core material arranged concentrically around at least one winding window; and at least one heat dissipating plate extending into an interior of the amorphous transformer core that is fed from the interior to at least one heat exchange region outside the amorphous transformer core for dissipation of heat energy produced inside the amorphous transformer core; at least one electrical winding formed as a hollow cylinder with a low-voltage and a high-voltage side; and at least one limb-like region of the amorphous transformer core passing through the at least one electrical winding in the hollow-cylindrical interior, the limb-like region being at least partially arranged in the at least one winding window.

BRIEF DESCRIPTION OF THE DRAWINGS

The disclosure, embodiments and advantages are described in more detail with reference to the exemplary embodiments shown in the drawings, wherein.

DETAILED DESCRIPTION

Figure 1:
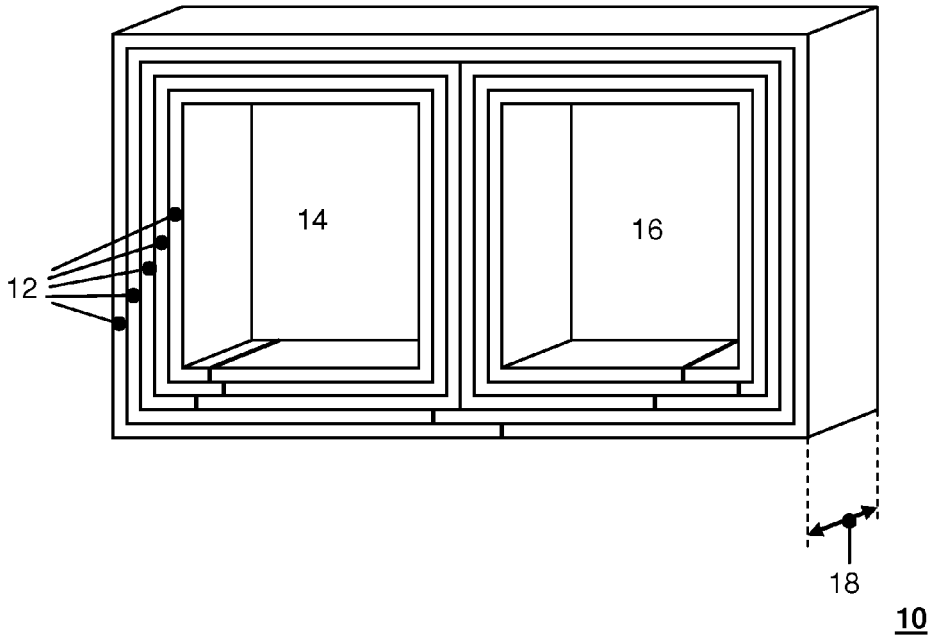
FIG. 1 shows an exemplary embodiment of a first transformer core disc in a three-dimensional view.

The disclosure relates to an amorphous transformer core which can enhance cooling and/or heat dissipation capability in order to avoid an increased use of material.

At least one heat dissipating plate extends into an interior of the amorphous transformer core and is fed from there into at least one heat exchange region outside the amorphous transformer core. This can provide improved dissipation of heat energy which is produced inside the amorphous transformer core relative to known configurations.

A build-up of heat, which occurs in the interior of an amorphous transformer core during operation where it can lead to an undesirable increase in temperature with an associated deterioration of the material properties, is dissipated to the outside by heat dissipating plates which are introduced into the interior of the core. The heat dissipating plates can be made from a material with high thermal conductivity, for example, higher than that of the amorphous strip material. Depending on the arrangement and distribution of the heat dissipating plates in the interior of the core, this can achieve a better cooling and a more homogenous temperature distribution in the interior of the core. This can enable the core cross section to be made smaller. Because of the way in which an amorphous transformer core is constructed, heat dissipating plates made from a multi-layer, thin amorphous strip material with a limited width can be introduced into the interior of the transformer core during its manufacture because the core is not constructed in a quasi-monolithic manner like known laminated transformer cores.

At least one end of such a heat dissipating plate can be fed to a heat exchange region, for example, close to the core. This can be designed in such a way that a large surface area can be provided for exchanging heat, for example, by a cooling-rib-like design. The heat dissipating plates can be connected to a heat sink. The heat can be dissipated from the heat exchange region to the environment by natural convection. However, forced cooling can also be used.

According to an exemplary embodiment of the amorphous transformer core according to the disclosure, the at least one heat dissipating plate can be arranged, at least in sections, between two adjacent layers of the strip-like amorphous core material and can be fed out of at least one side surface of the amorphous transformer core or of the amorphous transformer core disc. An amorphous transformer core disc can be pre-assembled from a plurality of layers of amorphous strip-like core material. This can be opened during the manufacture of a transformer in order to arrange the transformer windings over the core limb formed by the strip material. An amorphous core plate can cover a circuit of, for example, 360°. The joints of the respective plates can be provided in one of the formed yokes which can also constitute the respective opening point. When the transformer core or the transformer core disc is closed, packets of some 10 to 100 or more layers are alternately layered together enabling heat dissipating plates to be introduced between the layer packets during this process.

The planar contact between the respective heat dissipating plates and the adjacent layers of the strip-like amorphous core material can ensure a good thermal transfer. If a material which has magnetic properties is used for the heat dissipating plates, and heat dissipating plates of this kind are arranged in the joint region of respective layer packets, any magnetic weak points of the amorphous core that may be present there can be compensated. To reduce eddy current losses in the heat dissipating plates, it is possible to construct these with slots or in the form of a plurality of strips which are electrically insulated from one another and which are adjacent to one another. This does not significantly affect their thermal conductivity. An amorphous transformer core with improved heat dissipation from its interior can be produced in this way.

According to an exemplary embodiment of the disclosure, the at least one heat dissipating plate can be bent on at least one side surface of the transformer core disc. This can enable the heat dissipating plates to be fed in a space-saving manner to a heat exchange zone which is likewise provided in a space-saving manner above the transformer.

An exemplary embodiment of the transformer core according to the disclosure, includes at least two transformer core discs which are arranged parallel and at least approximately congruently adjacent to one another. At least one heat dissipating plate can be arranged, at least in sections, between the adjacent transformer core discs. Transformer cores for higher rated powers, for example in the region of 1 MVA and higher, can be constructed from a plurality of core discs due to the limited width of the available strip-like amorphous core material. In addition, the cooling problems and a non-uniform temperature distribution can be addressed here.

Heat dissipating plates can be arranged between two respective limb-like regions of adjacent transformer core discs. In later operation, the transformer can be arranged with the core vertical. In this case, the core discs can be arranged vertically so that the heat dissipating plates arranged between them also run vertically and end in a heat exchange zone provided above the transformer. However, a transformer can also be arranged with a horizontal amorphous core. Assuming that the side surfaces of the transformer core discs are flat, a planar heat transfer can take place via the side surfaces of the strip-like amorphous strip material to the respective adjacent heat dissipating plate.

In an exemplary embodiment of an amorphous transformer core according to the disclosure, the core can be mechanically stabilized by the at least one heat dissipating plate arranged between the congruently adjacent transformer core discs. For this purpose, it is desirable that the heat dissipating plate has a particular thickness, for example 1 mm to 15 mm, depending on the size and weight of the amorphous transformer core. Heat dissipating plates can also quite easily lie in an exemplary thickness range of 0.5 mm and below. It is therefore possible, for example, to provide a heat dissipating plate, which is arranged vertically in a limb area at the bottom, with a transversely running carrier plate, thus resulting in a T-shape. This can enable, for example, the respective adjacent transformer core discs to be supported from below on the transverse beam so formed. A heat dissipating plate of this kind can be bonded to the adjacent side surfaces of the transformer core discs in order to stabilize them. An adhesive with a high thermal conductivity can be used for this purpose, for example, with an additive of boron nitride, which is an outstanding thermal conductor. According to an exemplary embodiment of the disclosure, it is also possible to provide a holding device, for example, an eye, by which the transformer can be lifted using a crane or a similar lifting device, in the upper region of the heat dissipating plate. This can simply the handling of the transformer core.

In an exemplary embodiment according to the disclosure, a plurality of heat dissipating plates, which are arranged adjacently at least in sections, can be provided. The use of a plurality of heat dissipating plates can enable them to be distributed as uniformly within the amorphous transformer core, by which a further homogenized temperature distribution in operation can be achieved. However, these plates can be fed to a common heat exchange region above the transformer core, whereby the region between the core discs which runs vertically upwards, lends itself for this purpose, for example, when a plurality of transformer core discs are present. In order to form a strand which is compact, within which the heat dissipating plates are fed upwards, the plates are accordingly to be fed parallel to one another.

According to an exemplary embodiment of the disclosure, a common heat exchange region can enable a simple forced cooling, for example, by a fan or a heat exchanger. In this case, a single unit can be sufficient to force-cool the single heat exchange region.

To increase the heat dissipation from the interior of the amorphous transformer core, at least one heat dissipating plate can be made substantially (i.e., predominantly) from the metals copper or aluminium, which are distinguished by a relatively high thermal conductivity and also have sufficient mechanical stability.

Where a heat dissipating plate is provided between each of a plurality of single layers of the strip-like amorphous material, the plates can be designed in the form of a foil, for example, with a thickness of about 50 μm. This can enable particularly homogenous heat dissipation from the interior of the amorphous transformer core to be achieved. If the foil-like heat dissipating plates are provided with a layer of electrical insulation, this can reduce eddy current losses.

According to an exemplary embodiment of the disclosure, an increase in the heat dissipation can be achieved in that at least one heat dissipating plate is provided with a heat-conducting paste in a planar contact surface region with the strip-like amorphous core material, or also in that at least one heat dissipating plate is bonded to the strip-like amorphous core material in a planar contact surface region by an adhesive which has good thermal conductivity. In both cases, the heat transfer from the respective transformer core disc to the heat dissipating plate can be improved.

The integration of at least one cooling channel which runs vertically through the transformer core and which can be integrated in a limb-like region between adjacent transformer core disc can ensure heat dissipation due to the passage of a cooling medium, for example air, in combination with the heat dissipating plates.

The heat dissipation from the interior of the amorphous transformer core mentioned above can be available for a transformer including a transformer core according to an exemplary embodiment of the disclosure, at least one electrical winding in the form of a hollow cylinder with a low-voltage and a high-voltage side, at least one region of the limb-like amorphous transformer core passing through the at least one winding in the hollow-cylindrical interior, this being at least partially arranged in the at least one winding window. As a result of the electrical operation of the windings, for example, with a primary rated voltage of 20 kV, a secondary rated voltage of 400 V at a main frequency of 50 Hz, a heat input due to hysteresis losses, which can be less than with a known transformer core, occurs in the amorphous transformer core. This heat can then be conducted out of the interior of the transformer core by the heat dissipating plates according to exemplary embodiments of the disclosure, thus establishing a lower and more homogenous core temperature which ultimately can lead to improved magnetic operating characteristics of the amorphous core material.

FIG. 1 shows an exemplary first transformer core disc 10 in a three-dimensional view. A plurality of layers 12 made from a strip-like amorphous core material are arranged concentrically around two winding windows 14 and 16. In an exemplary embodiment, several thousand of such layers can be provided, each having a thickness in the range of about 0.05 mm to 0.1 mm, for example. The dimensions of the core can have a width in an exemplary range of 1.5 m to 4 m and an exemplary height of 1 m to 2.5 m and above, wherein this can depend on the nominal power to be produced by an appropriate transformer, which be 10 MVA and above. The width 18 of the transformer core disc can depend on the width of the amorphous strip material available and can be limited to 20 cm, for example, due to the commercially available strip widths and their high mechanical sensitivity. The core disc 10 is provided for a three-phase transformer with three windings, on account of which, in this case, three limb-like regions, which are provided to accommodate the three windings, are formed as a result of the two winding windows 14, 16. The edges of the transformer core disc are not sharp, but can be round, for example, with an internal bending radius of 1 cm and an external bending radius which is somewhat larger than the width of the limb. This core design means that ultimately three ring-like structures of amorphous strip-like core material can be formed, for example, a ring around each of the two winding windows 14, 16 and a third outer ring which encompasses the two inner rings. The joints of the respective layers are shown in the lower yoke region where the transformer core disc 10 can also be opened in order, for example, to arrange the transformer windings thereon. For this purpose, the core disc can be arranged suspended as shown, for example, in FIG. 1, wherein mechanical retaining structures, which enable an opening of the then inverted transformer core disc in the then upper yoke region, are also possible.

Figure 2:
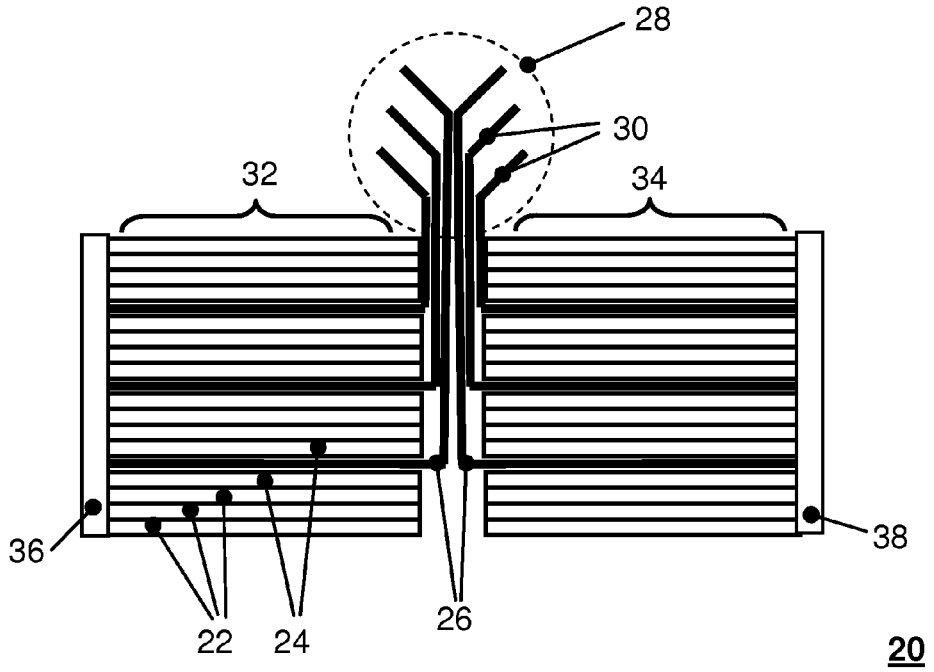
FIG. 2 shows a section through a first exemplary embodiment of an amorphous transformer core.

FIG. 2 shows a section 20 through a first exemplary transformer core with two congruent adjacently arranged transformer core discs 32, 34. These can be designed identically and correspond approximately to the transformer core disc shown in FIG. 1. However, a plurality of heat dissipating plates 26 are arranged between adjacent layers 24 and between layer packets including a plurality of layers. The planar contact surfaces in each case can provide a good heat transfer from the layers 22, 24 of the strip-like amorphous core material to the heat dissipating plates 26. This can be increased if desired by the use of a heat-conducting paste distributed over the surface. The uniform distribution of the heat dissipating plates 26 within the transformer core discs 32, 34 can enable a homogenous temperature distribution within the transformer core during operation. A channel-like region, in which the heat dissipating plates 26 which emerge from the sides of the transformer core discs 32, 34 end and which are bent upwards, can be formed between the transformer core discs 32, 34. The heat dissipating plates emerge from the transformer core at the top end of the channel-like region and end in a heat exchange region 28. This is provided in order to release the heat energy to the environment, for example by natural convection. This region can of course also be force-cooled, for example by ventilation, also with air which may already have been cooled. In order to increase this effect, the ends of the heat dissipating plates 30 are bent upwards in a similar manner to cooling ribs. An additional cooling effect occurs as a result of the contact of the upwardly fed heat dissipating plates with the inner side surfaces of the transformer core discs 32, 34, which in turn can be improved by the use of a heat-conducting paste in any cavities. Side plates 36, 38 are provided on each of the two outer sides of the transformer core which has two transformer core discs 32, 34. In this example, these can serve to mechanically stabilise the transformer core and, for example, are bonded, at least in some areas, to a respective side surface of the transformer core disc. However, it is possible to increase their natural heat dissipation functionality by also extending the side plates 36, 38 into a heat exchange region which lies outside the actual transformer core.

Figure 3:
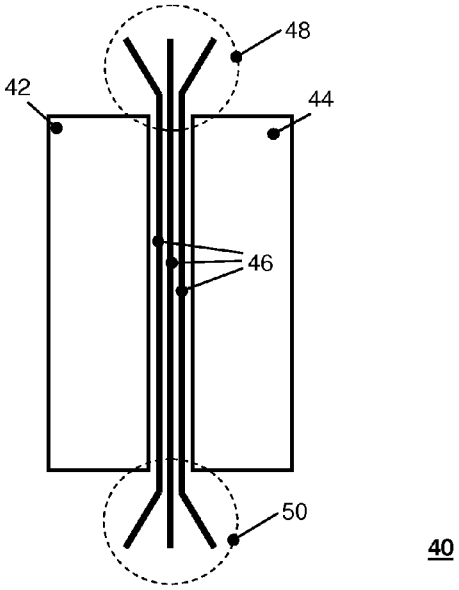
FIG. 3 shows a side view on a second exemplary embodiment of a transformer core.

FIG. 3 shows a side view 40 on a second exemplary embodiment of transformer core. The transformer core includes two congruently adjacent transformer core discs 42, 44, a channel-like region being formed between the two. A plurality of heat dissipating plates 46, which fill the channel at least in the limb-like region, are provided so that the plates run parallel to one another transversely through this region and between two limb-like regions of the transformer core discs 42, 44. This can provide a good heat transfer from the affected regions of the side surfaces of the transformer core discs to the heat dissipating plates 46 which adjoin in a planar manner. Heat transfer can be improved by the use of a heat-conducting paste. It is also possible to design the heat dissipating plates 46 in a mechanically particularly stable manner, for example with a thickness of about 10 mm, and to bond these in some areas to the transformer core discs 42, 44. This can increase the stability of the transformer core discs 42, 44, which can be weak due to the material, and can also improve the heat dissipation when an adhesive with particularly high thermal conductivity is used. Such an adhesive could be based on an epoxy resin, for example, to which a filler with good thermal conductivity, such as boron nitride, for example, has been added. In order to simplify the drawing, only one vertically running packet of heat dissipating plates 46 is shown. However, a separate packet of heat dissipating plates 46 can be provided for every limb-like region. The heat dissipating plates 46 end in the upper and in the lower transformer core region in a respective heat exchange region 50.

Figure 4:
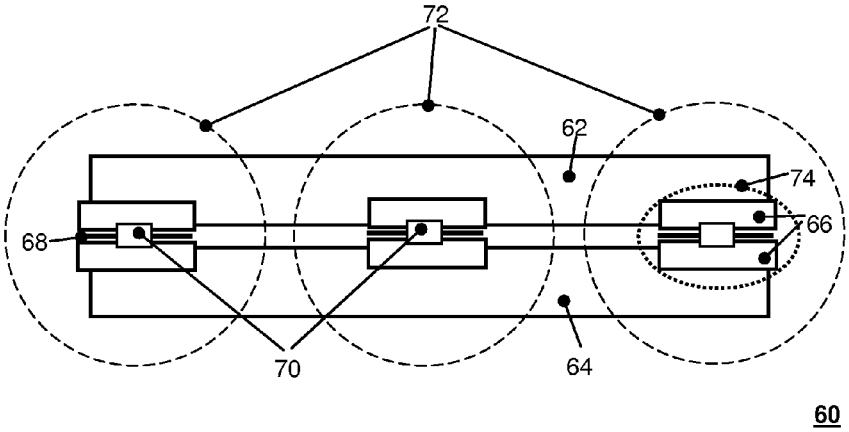
FIG. 4 shows a plan view of a third exemplary embodiment of a transformer core with windings.

FIG. 4 shows a plan view 60 on a third exemplary embodiment of a transformer core with windings. Apart from the changed perspective, this corresponds substantially to the transformer core shown in FIG. 3. The transformer core includes two congruently adjacent transformer core discs 62, 64, between which a gap is formed. Heat dissipating plates 66, 68, which end in a respective heat exchange region 74, are arranged in this gap in the yoke areas in the form of a packet. However, additional cooling channels 70, which in turn can ensure improved heat dissipation, are provided within the respective limb regions. Here, it is useful when a cooling medium is forced through the cooling channels. The contours of the windings on the respective core limbs are shown with the reference number 72. The use of three, four or more congruently adjacent transformer core discs can be possible.

Figure 5:
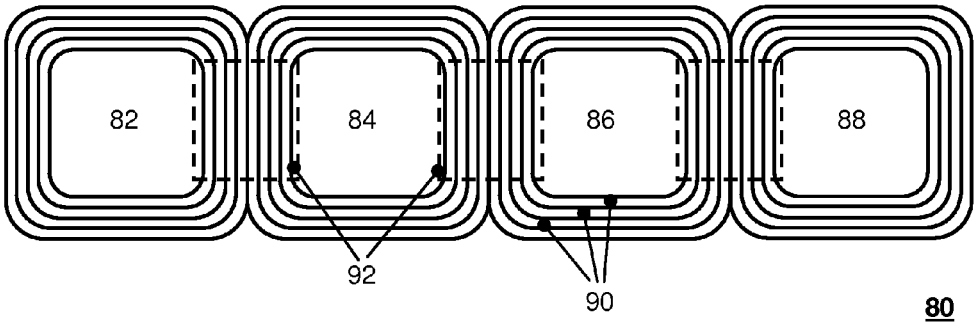
FIG. 5 shows an exemplary embodiment of a second core disc.

FIG. 5 shows an exemplary second transformer core disc 80 with four winding windows 82, 84, 86, 88 and layers 92 of strip-like amorphous material arranged concentrically around them. Three limb-like regions 92, which are provided for accommodating one winding in each case, are shown. The two outer limb-like regions are provided for magnetic feedback so that this form is similar to the form of a five-limb core.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCES

10 exemplary first transformer core disc
12 first layers of strip-like amorphous core material
14 first winding window
16 second winding window
18 width of first transformer core disc
20 section through first exemplary amorphous transformer core
22 second layers of strip-like amorphous core material
24 adjacent layers of strip-like amorphous core material
26 first heat dissipating plates
28 first heat exchange region
30 cooling-rib-like ends of first heat dissipating plates
32 first transformer core disc of first transformer core
34 second transformer core disc of first transformer core
36 first side plate of first transformer core
38 second side plate of first transformer core
40 side view of second exemplary transformer core
42 first transformer core disc of second transformer core
44 second transformer core disc of second transformer core
46 second heat dissipating plates
48 second heat exchange region
50 third heat exchange region
60 plan view on third exemplary transformer core with windings
62 first transformer core disc of third transformer core
64 second transformer core disc of third transformer core
66 bent ends of third heat dissipating plates
68 third heat dissipating plate
70 cooling channels
72 windings
74 fourth exchange region
80 exemplary second core disc
82 third winding window
84 fourth winding window
86 fifth winding window
88 sixth winding window
90 third layer of strip-like amorphous core material
92 limb-like region

What is claimed is:

1. An amorphous transformer core comprising:

at least two transformer core discs, each with a plurality of layers of strip-like amorphous core material wound concentrically around at least one winding window; and at least one first heat dissipating plate extending into an interior of one of the at least two transformer core discs and at least one second heat dissipating plate extending into an interior of the other of the at least two transformer core discs, each heat dissipating plate fed from the interiors to at least one heat exchange region outside the amorphous transformer core for dissipation of heat energy produced inside the amorphous transformer core, wherein each at least one heat dissipating plate is respectively arranged at least in sections between two adjacent layers of the strip-like amorphous core material and is fed out of at least one side surface of the amorphous transformer core, the at least two transformer core discs arranged in parallel and at least approximately congruently adjacent to one another and form a channel therebetween, and the at least one first and second heat dissipating plates are arranged between the adjacent transformer core discs in the channel.

2. The amorphous transformer core according to claim 1, wherein the at least one heat dissipating plate is bent on the at least one side surface.

3. The amorphous transformer core according to claim 1, wherein the core is mechanically stabilised by at least one heat dissipating plate arranged between the congruently adjacent transformer core discs.

4. The amorphous transformer core according to claim 3, wherein at least one heat dissipating plate arranged between the congruently adjacent transformer core discs comprises:

a holding device in a heat exchange region.

5. The amorphous transformer core according to claim 1, wherein the heat dissipating plates are arranged adjacently at least in sections in the channel.

6. The amorphous transformer core according to claim 5, wherein the heat dissipating plates are fed into a common heat exchange region.

7. The amorphous transformer core according to claim 1, wherein at least one heat dissipating plate is made substantially from copper or aluminium.

8. The amorphous transformer core according to claim 1, wherein at least one heat dissipating plate is designed as a foil.

9. The amorphous transformer core according to claim 1, wherein at least one heat dissipating plate is provided with a heat-conducting paste in a planar contact surface region with the strip-like amorphous core material.

10. The amorphous transformer core according to claim 1, wherein at least one heat dissipating plate is bonded to the strip-like amorphous core material in a planar contact surface region by an adhesive.

11. The amorphous transformer core according to claim 1, comprising:

cooling channels formed between adjacent transformer core discs.

12. The amorphous transformer core according to claim 1, comprising:

a cooling device for forced cooling of at least one heat exchange region.

13. A transformer comprising:

an amorphous transformer core having at least two transformer core discs, each with a plurality of layers of strip-like amorphous core material wound concentrically around at least one winding window;

at least one first heat dissipating plate extending into an interior of one of the at least two transformer core discs and at least one second heat dissipating plate extending into an interior of the other of the at least two transformer core discs, each heat dissipating plate fed from the interior to at least one heat exchange region outside the amorphous transformer core for dissipation of heat energy produced inside the amorphous transformer core;

the at least two transformer core discs arranged in parallel and at least approximately congruently adjacent to one another and form a channel therebetween, and the at least one first and second heat dissipating plates are arranged between the adjacent transformer core discs in the channel;

at least one electrical winding formed as a hollow cylinder with a low-voltage and a high-voltage side; and at least one limb-like region of the amorphous transformer core passing through the at least one electrical winding in the hollow-cylindrical interior, the limb-like region being at least partially arranged in the at least one winding window.

* * * * *